US012687326B2

(12) United States Patent
Zhang et al.

(10) Patent No.: US 12,687,326 B2
(45) Date of Patent: Jul. 21, 2026

(54) AIR COOLING-TYPE REFRIGERATION DEVICE

(71) Applicants: QINGDAO HAIER REFRIGERATOR CO., LTD., Qingdao (CN); HAIER SMART HOME CO., LTD., Qingdao (CN)

(72) Inventors: Yuning Zhang, Qingdao (CN); Bin Fei, Qingdao (CN); Mengcheng Li, Qingdao (CN); Yao Yi, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 280 days.

(21) Appl. No.: 18/682,820

(22) PCT Filed: Jun. 22, 2022

(86) PCT No.: PCT/CN2022/100407
§ 371 (c)(1),
(2) Date: Feb. 9, 2024

(87) PCT Pub. No.: WO2023/016094
PCT Pub. Date: Feb. 16, 2023

(65) Prior Publication Data

US 2024/0361047 A1 Oct. 31, 2024

(30) Foreign Application Priority Data

Aug. 11, 2021 (CN) ..... 202110920585.9

(51) Int. Cl.
*F25B 21/00* (2006.01)
*F25D 17/06* (2006.01)

(52) U.S. Cl.
CPC ..... *F25B 21/00* (2013.01); *F25D 17/062* (2013.01); *F25B 2321/00* (2013.01); *F25B 2500/05* (2013.01); *F25B 2500/18* (2013.01)

(58) Field of Classification Search
CPC ..... F25D 11/02; F25D 17/062; F25D 17/08; F25D 25/02; F25D 25/025; F25D 29/00;
(Continued)

(56) References Cited

U.S. PATENT DOCUMENTS 5,156,015 A * 10/1992 Chung ..... F25D 17/065 62/187
5,887,446 A * 3/1999 Lee ..... F25D 27/00 335/206

(Continued)

FOREIGN PATENT DOCUMENTS

CN 106642909 A 5/2017
CN 108662832 A 10/2018

(Continued)

OTHER PUBLICATIONS

Machine Translation of CN 214536999 (Year: 2021).*
Machine Translation of CN 216114967 (Year: 2022).*

*Primary Examiner* — Filip Zec
(74) *Attorney, Agent, or Firm* — MUNCY, GEISSLER, OLDS & LOWE, P.C.

(57) ABSTRACT

An air cooling-type refrigeration device includes a device body, an air cooling system attached to the device body, and a drawer which may be pulled out relative to the device body, the drawer being capable of receiving cold air provided by the air cooling system, so as to cool an object stored in the drawer. The air cooling-type refrigeration device further comprises a magnetic field generating apparatus and a detection apparatus. When the magnetic field generating apparatus is powered on, a magnetic field acting on the object stored in the drawer is generated. The detection (Continued)

apparatus is used to detect whether the drawer is pulled out. The magnetic field generating apparatus and the detection apparatus are configured such that the magnetic field generating apparatus is powered off when the detection apparatus detects that the drawer is pulled out.

10 Claims, 6 Drawing Sheets

(58) Field of Classification Search
CPC .. F25B 21/00; F25B 2321/00; F25B 2500/05; F25B 2500/18
See application file for complete search history.

(56) References Cited

U.S. PATENT DOCUMENTS

| | | | | |
|---|---|---|---|---|
| 6,133,555 | A * | 10/2000 | Brenn | F25D 29/00 219/494 |
| 7,228,704 | B2 * | 6/2007 | Rand | F25D 25/025 62/382 |
| 7,757,511 | B2 * | 7/2010 | LeClear | F25C 1/04 62/340 |
| 8,459,818 | B2 * | 6/2013 | Becke | F25D 27/00 362/92 |
| 10,317,131 | B2 * | 6/2019 | Eicher | F21V 33/0012 |
| 10,408,524 | B2 * | 9/2019 | Djerekarov | F25D 17/065 |
| 11,815,303 | B2 * | 11/2023 | Zanqueta | F25D 29/00 |
| 12,133,546 | B2 * | 11/2024 | Tanaka | A23B 2/60 |
| 2010/0320890 | A1 * | 12/2010 | Jung | F25D 27/00 312/405 |
| 2013/0160467 | A1 | 6/2013 | Hall et al. | |
| 2013/0298571 | A1 * | 11/2013 | Morimoto | B60H 1/32 62/3.1 |
| 2018/0031311 | A1 | 2/2018 | Hao et al. | |
| 2018/0149419 | A1 * | 5/2018 | Eveland | F25D 23/028 |
| 2020/0224951 | A1 * | 7/2020 | Seong | F25D 23/04 |
| 2020/0309449 | A1 * | 10/2020 | Hui | F25D 25/025 |

FOREIGN PATENT DOCUMENTS

| | | | |
|---|---|---|---|
| CN | 112747555 | A | 5/2019 |
| CN | 111043826 | A | 4/2020 |
| CN | 111503984 | A | 8/2020 |
| CN | 111503985 | A | 8/2020 |
| CN | 214536999 | U | 10/2021 |
| CN | 216114967 | U | 3/2022 |
| JP | H11155831 | A | 6/1999 |
| JP | 2000157161 | A | 6/2000 |
| JP | 2008106994 | A | 5/2008 |
| JP | 2011153788 | A | 8/2011 |
| JP | 2012207900 | A | 10/2012 |
| JP | 2014159896 | A | 9/2014 |

* cited by examiner

AIR COOLING-TYPE REFRIGERATION DEVICE

TECHNICAL FIELD

The present invention relates to the field of refrigeration and freezing technology, and in particular, to an air cooling-type refrigeration device.

BACKGROUND

A cooling equipment that is air cooled is a device used to refrigerate and freeze objects, including food ingredients, medicines, beverages, biological reagents, colonies, chemical reagents, etc.

A theoretical study has demonstrated that magnetic fields have a significant impact on the formation of ice crystals during the freezing process. By applying a magnetic field, it is possible to lower the freezing temperature of food ingredients. Consequently, some air-cooled refrigeration equipment is equipped with a magnetic field generator to provide a magnetic field to the stored objects (especially high-end food). This is intended to achieve low-temperature preservation.

However, the magnetic field generator has the potential to increase the energy consumption of air-cooled refrigeration equipment. This requires further optimization of existing air-cooled refrigeration equipment.

SUMMARY

An object of the present invention is to provide an air cooling-type refrigeration device with a magnetic field generating apparatus that has a reduced energy consumption.

In particular, the present invention is directed to an air cooling-type refrigeration device, comprising:

a device body, an air-cooling system attached to the device body, and a drawer that can be pulled out relative to the device body, the drawer being capable of receiving cold air provided by the air-cooling system to cool objects stored in it;

wherein the air cooling-type refrigeration device comprises a magnetic field generating apparatus and a detection apparatus, when powered on, the magnetic field generating apparatus generates a magnetic field that acts on the objects stored in the drawer, the detection apparatus is used to detect whether the drawer is pulled out;

the magnetic field generating apparatus and the detection apparatus are configured such that the magnetic field generating apparatus is powered off when the detection apparatus detects that the drawer is pulled out.

Further, the air cooling system comprises an air door, the air door is configured to close when the magnetic field generating apparatus is in a power-off state, for preventing the air cooling system from providing cold air to the drawer, the air door is opened when the magnetic field generating apparatus is in a power-on state, for allowing the air cooling system to provide cold air to the drawer.

Further, the air door is configured to open when the detection apparatus detects that the drawer has returned to the initial position, and the magnetic field generating apparatus is powered on, for allowing the air cooling system to provide cold air to the drawer.

Further, the air-cooled refrigeration equipment further comprises a temperature sensor for detecting the temperature in the drawer, the air door is further configured to open if the temperature sensor detects that the temperature inside the drawer is within a preset high temperature range while the magnetic field generating apparatus is energized, and the air door is configured to close if the temperature sensor detects that the temperature inside the drawer is within a preset low temperature range.

Further, the detection apparatus comprises a magnet and a magnetic field sensor, one of the magnet and the magnetic field sensor is arranged on the drawer, and the other is arranged on the device body.

Further, the magnetic field sensor is a Hall switch or a reed switch.

Further, the detection apparatus comprises a micro switch, and the micro switch is installed on the device body or the drawer.

Further, the magnetic field generation device comprises a first electromagnetic coil and a second electromagnetic coil disposed on opposite sides of the drawer.

Further, the magnetic field generation device additionally comprises a first magnetic guiding component corresponding to the first electromagnetic coil and a second magnetic guiding component corresponding to the second electromagnetic coil; and/or the air cooling-type refrigeration device further comprises a first accommodating cavity for receiving the first electromagnetic coil and a second accommodating cavity for receiving the second electromagnetic coil, the first accommodating cavity and the second accommodating cavity are communicated with the drawer, thereby allowing the cold air provided by the air cooling system to enter the drawer through the first accommodating cavity and the second accommodating cavity.

Further, the magnetic field generating apparatus is further configured to energize when the temperature inside the drawer drops below a predetermined temperature.

Based on the foregoing description, it is understood by a person skilled in the art that in the aforementioned technical scheme of the invention, by making the magnetic field generating apparatus power off when the detection apparatus detects that the drawer is pulled out, the magnetic field generating apparatus can avoid useless work when the drawer is pulled out, thereby ensuring that the magnetic field generated during the power-on process of the magnetic field generating apparatus can affect the stored objects in the drawer. Consequently, the present invention reduces energy consumption by improving the utilization rate of the magnetic field.

Furthermore, by powering on the magnetic field generating apparatus when the temperature inside the drawer drops below a preset temperature, the magnetic field generated by the magnetic field generating apparatus only acts on the stored objects when the temperature is relatively low (especially near the freezing temperature). This prevents the stored objects from freezing, thereby improving the utilization rate of the magnetic field and reducing energy consumption in the air-cooled refrigeration equipment.

In addition, by using a weighing sensor or an image recognition unit to identify whether there are any objects stored in the drawer, it is possible to judge whether there are any objects and only activate the magnetic field-generating device when there are any objects stored in the drawer, thereby avoiding unnecessary electricity consumption when there are no objects stored in the drawer.

The above and other objects, advantages and features of the present invention will become more apparent to those skilled in the art from the following detailed description of specific embodiments thereof taken in conjunction with the accompanying drawings.

BRIEF DESCRIPTION OF THE DRAWINGS

Some specific embodiments of the invention will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

It should be understood by the person of ordinary skill in the art that the embodiments described hereinafter are only a part of the embodiments of the present invention and not all of the embodiments of the present invention, and that this part of the embodiments is intended to be used for explaining the technical principles of the present invention, and is not intended to be used for restricting the scope of protection of the present invention. Based on the embodiments provided in the present invention, all other embodiments obtained by a person of ordinary skill in the art without creative labor shall still fall within the scope of protection of the present invention.

It is to be noted that in the description of the present invention the terms "center", "top", "bottom", "top", "bottom", "left", "right", "vertical", "horizontal," "inside," "outside," and other terms indicative of directional or positional relationships are based on the directional or positional relationships shown in the accompanying drawings, which are for convenience of description only and do not indicate or imply that said device or element must have a particular orientation, be constructed and operated in a particular orientation, and therefore are not to be construed as a limitation of the present invention. Furthermore, the terms "first", "second", and "third" are used for descriptive purposes only and are not to be construed as indicating or implying relative importance.

Furthermore, it is to be noted that in the description of the present invention, unless otherwise expressly specified and limited, the terms "mounted", "connected", "connected" are to be understood in a broader sense, for example The connection may be a fixed connection, a removable connection, or a connection in one piece; it may be a mechanical connection or an electrical connection; it may be a direct connection or an indirect connection through an intermediate medium, or it may be a connection within the two elements. For a person skilled in the art, the specific meaning of the above terms in the present invention may be understood according to the specific circumstances.

Figure 1:
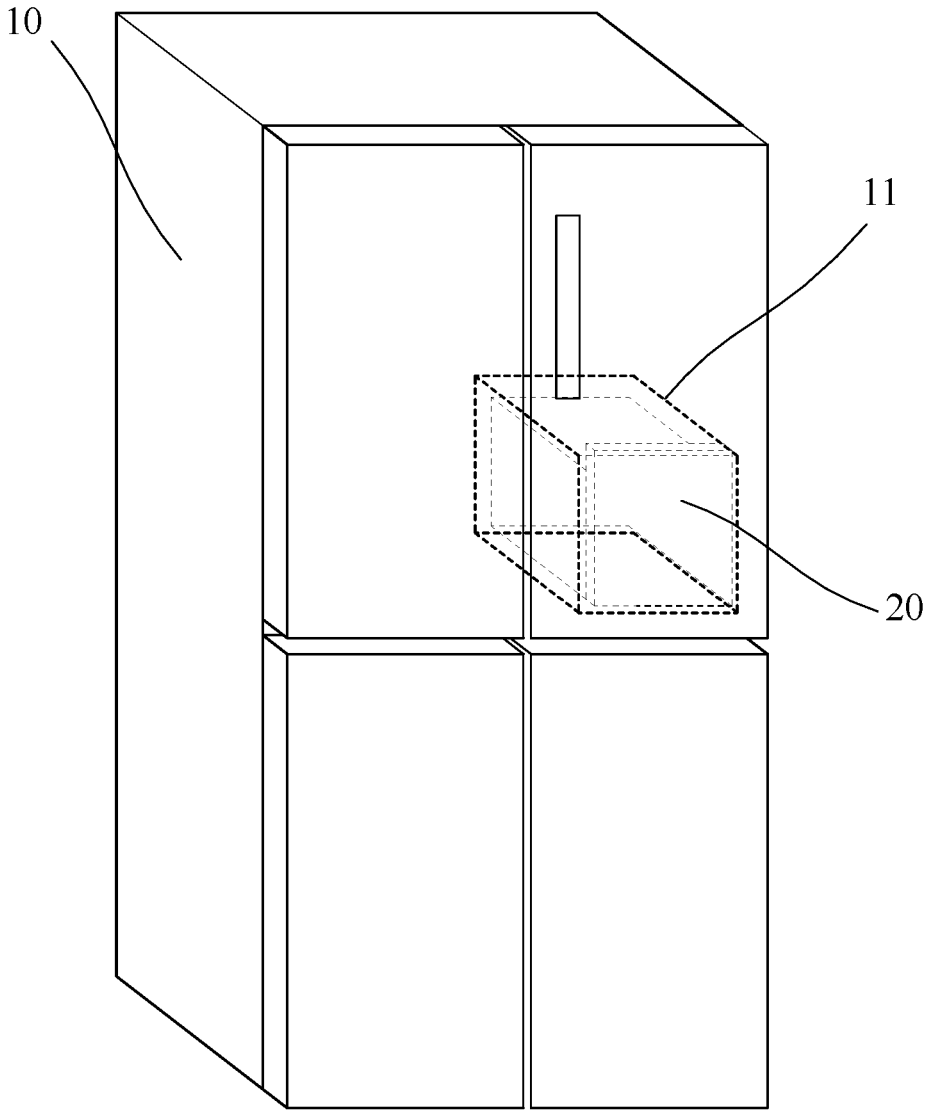
FIG. 1 is a schematic perspective view of an air cooling-type refrigeration device according to some embodiments of the present invention.
Figure 2:
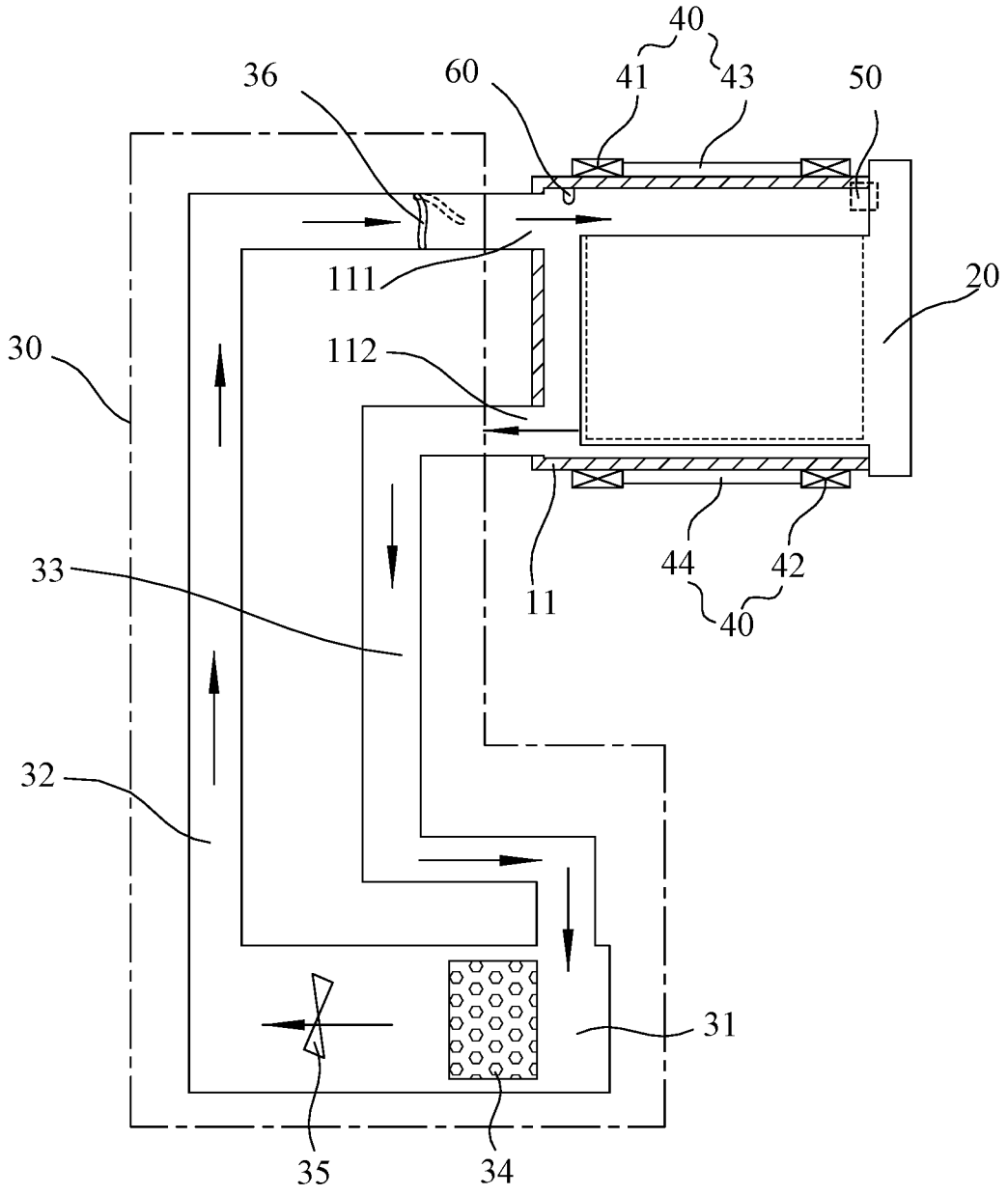
FIG. 2 is a schematic diagram of the air cooling-type refrigeration device in some embodiments of the present invention.
Figure 3:
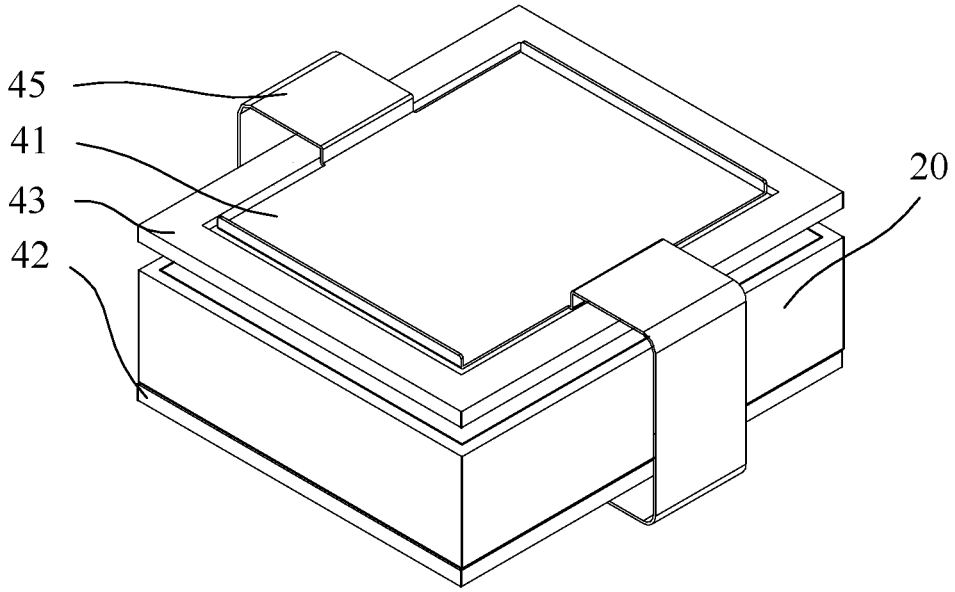
FIG. 3 is a schematic diagram of the axonometric effect of a magnetic field generating apparatus and a drawer in some embodiments of the present invention.
Figure 4:
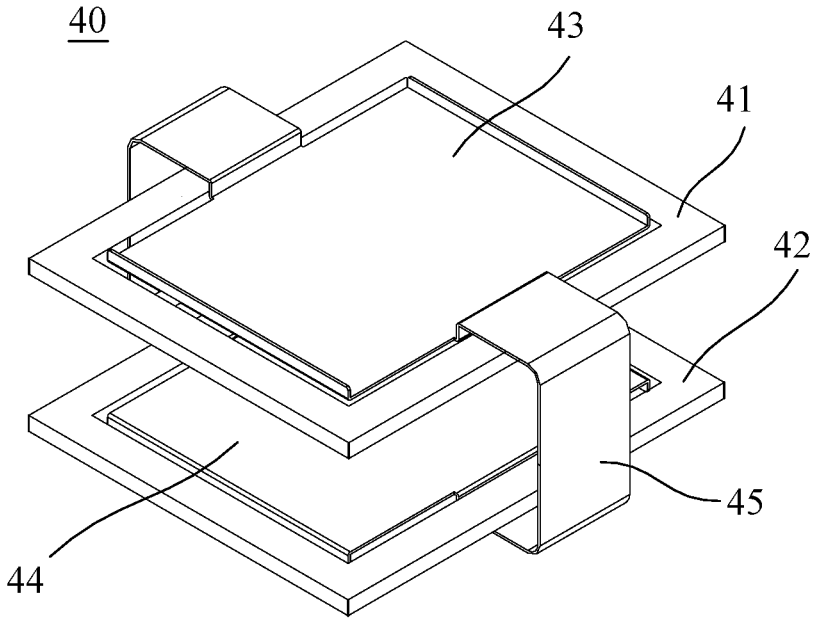
FIG. 4 is a cross-sectional view of the magnetic field generating apparatus in some embodiments of the present invention.
Figure 5:
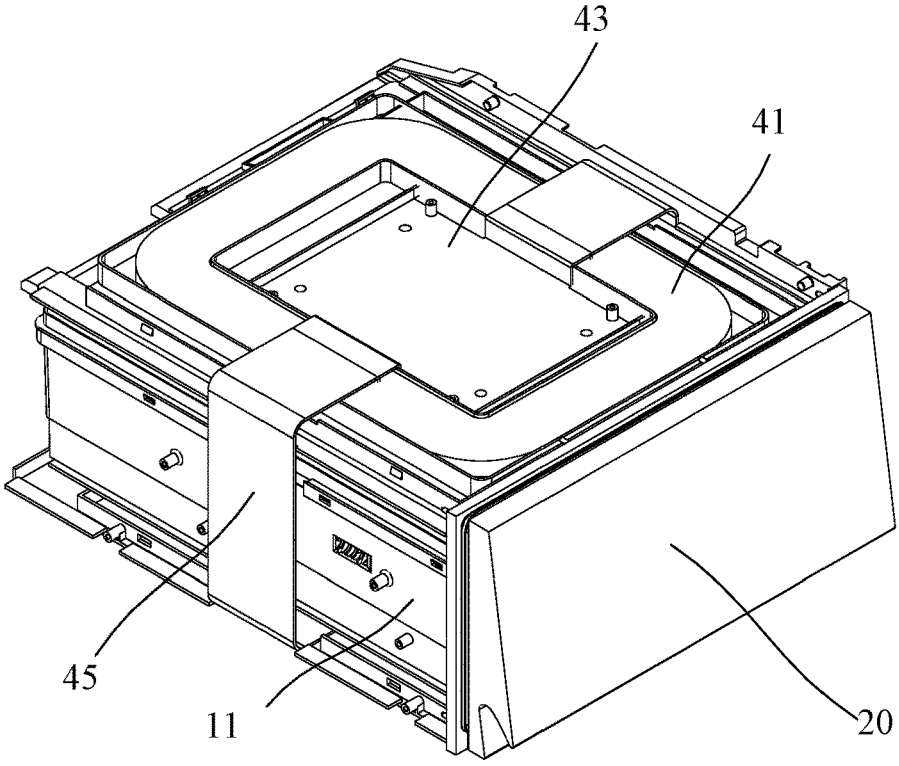
FIG. 5 is a front upper axonometric view of the drawer container and magnetic field generating apparatus in some embodiments of the present invention.
Figure 6:
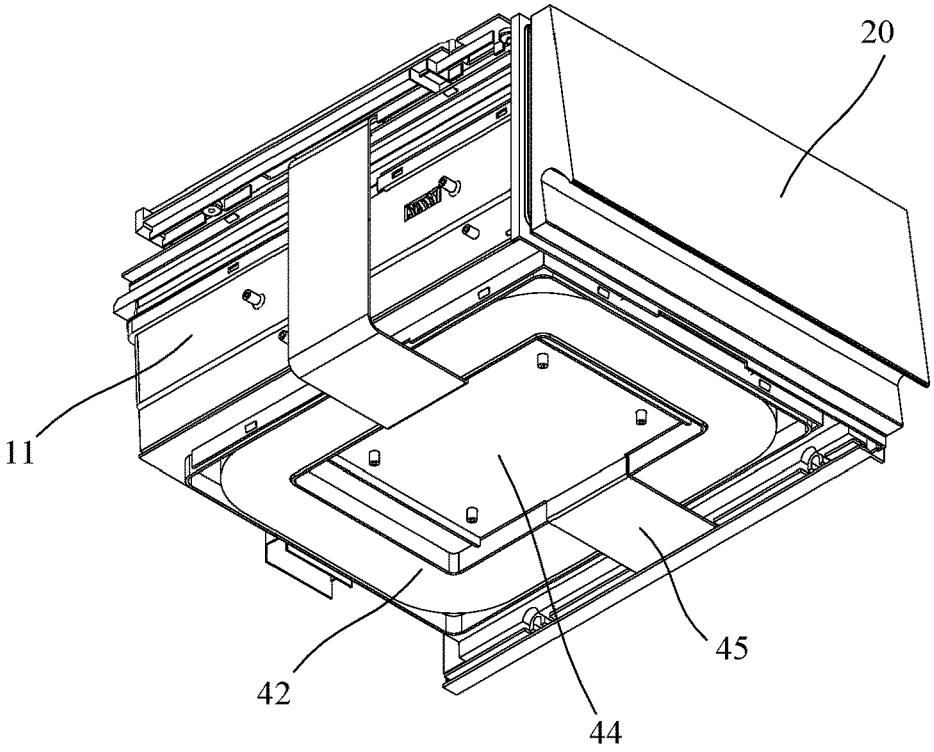
FIG. 6 is a front lower axonometric view of the drawer container and magnetic field generating apparatus in some embodiments of the present invention.
Figure 7:
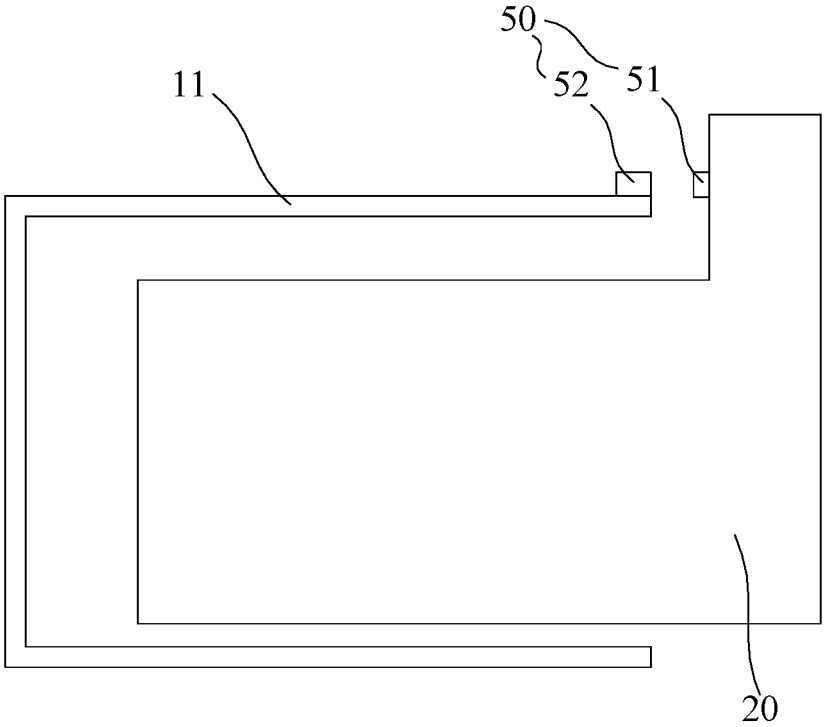
FIG. 7 is a schematic diagram of the effect of the detection apparatus in some embodiments of the present invention.

FIG. 1 is a schematic perspective view of an air cooling-type refrigeration device according to some embodiments of the present invention; FIG. 2 is a schematic diagram of the air cooling-type refrigeration device in some embodiments of the present invention; FIG. 3 is a schematic diagram of the axonometric effect of a magnetic field generating apparatus and a drawer in some embodiments of the present invention; FIG. 4 is a cross-sectional view of the magnetic field generating apparatus in some embodiments of the present invention; FIG. 5 is a front upper axonometric view of the drawer container and magnetic field generating apparatus in some embodiments of the present invention; FIG. 6 is a front lower axonometric view of the drawer container and magnetic field generating apparatus in some embodiments of the present invention; FIG. 7 is a schematic diagram of the effect of the detection apparatus in some embodiments of the present invention.

As shown in FIGS. 1 and 2, in some embodiments of the present invention, the air cooling-type refrigeration device comprises a device body 10, a drawer 20, an air-cooling system 30, a magnetic field generation device 40, and a temperature sensor 60. The drawer 20 is installed on the device body 10 in a pull-out manner, and the drawer 20 is used to store stored objects (including food, medicine, beverages, biological reagents, colonies, chemical reagents, etc.). The air-cooling system 30 is attached to the device body 10 and is capable of providing cold air to the drawer 20 to cool the stored objects inside the drawer 20. The magnetic field generation device 40 is used to generate a magnetic field, which acts on the stored objects inside the drawer 20. The temperature sensor 60 detects the temperature of the air inside the drawer 20 directly or indirectly.

As shown in FIG. 1, the device body 10 defines a drawer container 11, and the drawer 20 is installed on the drawer container 11 in a pull-out manner. The drawer container 11 can be a component specifically designed for the drawer 20, or it can be a refrigeration compartment, a freezer compartment, or a variable temperature compartment of an air-cooling refrigeration equipment.

As shown in FIG. 2, the drawer container 11 is provided with a cold air inlet 111 and a cold air outlet 112. The drawer container 11 receives cold air provided by the air cooling system 30 through the cold air inlet 111, thereby cooling the objects stored in the drawer 20. The air inside the drawer container 11 is discharged through the cold air outlet 112.

As shown in FIG. 2, in some embodiments of the present invention, the air cooling system 30 comprises a freezer compartment 31, a supply air duct 32, a return air duct 33, an evaporator 34, a fan 35, and an air door 36. The freezer compartment 31 is connected to the drawer container 11 via the supply air duct 32 and the return air duct 33. Specifically, the freezer compartment 31 is communicated with the cold air inlet 111 via the supply air duct 32, and the freezer compartment 31 is communicated with the cold air outlet 112 via the return air duct 33. The evaporator 34 is disposed inside the freezer compartment 31 and is used to cool the air inside the freezer compartment 31. The fan 35 is located inside the freezer compartment 31 or the supply air duct 32 or the return air duct 33, and is used to drive the air flow inside the freezer compartment 31, thereby forming cold air flowing towards the drawer container 11. The air door 36 is located inside the supply air duct 32, preferably near the cold air inlet 111 in the supply air duct 32. When the air door 36 is open, the cold air inside the supply air duct 32 can flow towards the drawer container 11. When the air door 36 is closed, the cold air inside the supply air duct 32 cannot flow towards the drawer container 11.

As shown in FIGS. 2 to 6, the magnetic field generating apparatus 40 comprises a first electromagnetic coil 41, a second electromagnetic coil 42, a first magnetic guiding component 43, a second magnetic guiding component 44 and a magnetic connecting member 45. The first electromagnetic coil 41 and the second electromagnetic coil 42 are positioned on opposite sides of the drawer 20, preferably, the first electromagnetic coil 41 and the second electromagnetic coil 42 are positioned on the top and bottom sides of the drawer 20, respectively. Furthermore, the first electromagnetic coil 41 and the second electromagnetic coil 42 are both positioned outside of the drawer container 11 to prevent the heat generated during the power-on process of the first electromagnetic coil 41 and the second electromagnetic coil 42 from affecting the refrigeration or freezing of the stored objects inside the drawer 20.

In addition, in other embodiments of the present invention, it is possible for those skilled in the art to set the first electromagnetic coil 41 and the second electromagnetic coil 42 on the left and right sides of the drawer 20 respectively, and then selectively set the first electromagnetic coil 41 and the second electromagnetic coil 42 on the inside of the drawer container 11. This will allow the first electromagnetic coil 41 and the second electromagnetic coil 42 to also be cooled by the cold air entering the drawer container 11.

Referring to FIGS. 2 to 6, the first magnetic guiding component 43 corresponds to the first electromagnetic coil 41, while the second magnetic guiding component 44 corresponds to the second electromagnetic coil 42. The first and second magnetic guiding components 43, 44 are used to assist the first electromagnetic coil 41 and the second electromagnetic coil 42 to form a uniformly strong magnetic field inside the drawer 20, thereby ensuring that the food in different areas of the drawer 20 is exposed to the same magnetic field environment, and a good magnetic preservation environment is provided for stored objects in drawer 20. Additionally, the setting of the first magnetic guiding component 43 and the second magnetic guiding component 44 also facilitates the control of the strength of the magnetic field formed by the first electromagnetic coil 41 and the second electromagnetic coil 42, thereby avoiding the occurrence of excessive high or low magnetic field strength in local areas inside the drawer 20.

As shown in FIGS. 3 to 6, the magnetic connecting member 45 establishes a magnetic connection between the first magnetic guiding component 43 and the second magnetic guiding component 44.

In the present invention, the magnetic connecting member 45 at least prevents the magnetic field leakage of the first electromagnetic coil 41 and the second electromagnetic coil 42. That is, the magnetic field generated by the first electromagnetic coil 41 and the second electromagnetic coil 42 can be limited. Specifically, the magnetic field generated by the first electromagnetic coil 41 and the second electromagnetic coil 42 is limited in the drawer 20, so that the magnetic field as much as possible to the stored objects in the drawer 20. As a result, the present invention improves the utilization rate of the magnetic field of the first electromagnetic coil 41 and the second electromagnetic coil 42 by setting the first magnetic guiding component 43, the second magnetic guiding component 44, and the magnetic connecting member 45.

It is important to note that the first magnetic guiding component 43, the second magnetic guiding component 44, and the magnetic connecting member 45 can be any suitable magnetic guiding components, such as silicon steel sheets, 45 permalloy, 78 permalloy, super permalloy, etc.

As shown in FIGS. 5 and 6, the first magnetic guiding component 43, the second magnetic guiding component 44, and the magnetic connecting member 45 are disposed on the outside of the drawer container 11 for installation and fixation purposes of the first magnetic guiding component 43, the second magnetic guiding component 44 and the magnetic connecting member 45. Technicians can also, as needed, the first magnetic component 43, the second magnetic component 44 and the magnetic connecting member 45 are disposed on the inner side of the drawer container 11.

As shown in FIGS. 2 and 7, in some embodiments of the present invention, the detection apparatus 50 includes a magnet 51 and a magnetic field sensor 52. In this case, the magnet 51 is positioned on the drawer 20, while the magnetic field sensor 52 is positioned on the drawer container 11. Additionally, the magnet 51 can be positioned on the drawer container 11 and the magnetic field sensor 52 can be positioned on the drawer 20, as needed by the technicians in this field.

In some embodiments of the present invention, when the drawer 20 is in its initial position (inserted into drawer container 11), the magnetic field sensor 52 can detect the magnetic field generated by the magnet 51, this allows the air cooling-type refrigeration device to judge that the drawer 20 is in the initial position based on this.

In addition, in other embodiments of the present invention, the skilled artisan can detect the magnetic field generated by the magnet 51 using the magnetic field sensor 52 when the drawer 20 is completely pulled out from the drawer container 11. This can help the air cooling-type refrigeration device judge whether the drawer 20 has been pulled out.

The magnetic field sensor 52 in the present invention is a Hall switch or a reed switch.

Figure 8:
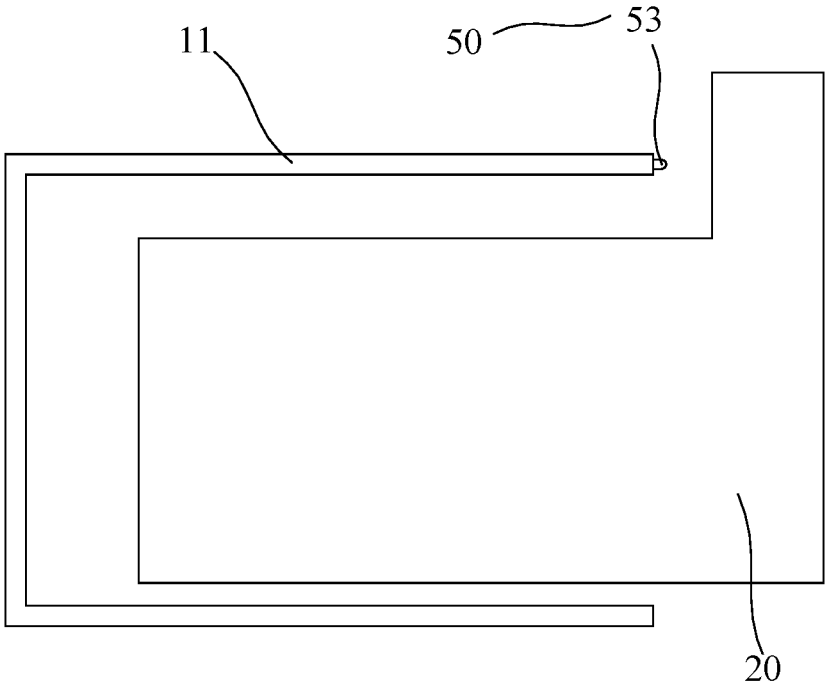
FIG. 8 is a schematic diagram of the effect of the detection apparatus in other embodiments of the present invention.

FIG. 8 is a schematic diagram of the effect of the detection apparatus in other embodiments of the present invention.

As shown in FIG. 8, in a further embodiment of the present invention, the detection apparatus 50 comprises a micro switch 53, which is installed on the device body 10 of the device (specifically, on the drawer container 11). When the drawer 20 is moved to its initial position, the micro switch 53 is triggered, thereby enabling the air cooling-type refrigeration device to judge that the drawer 20 is in its initial position.

In addition, in other embodiments of the present invention, it is possible for those skilled in the art to place the micro switch 53 on the drawer 20 as needed.

Figure 9:
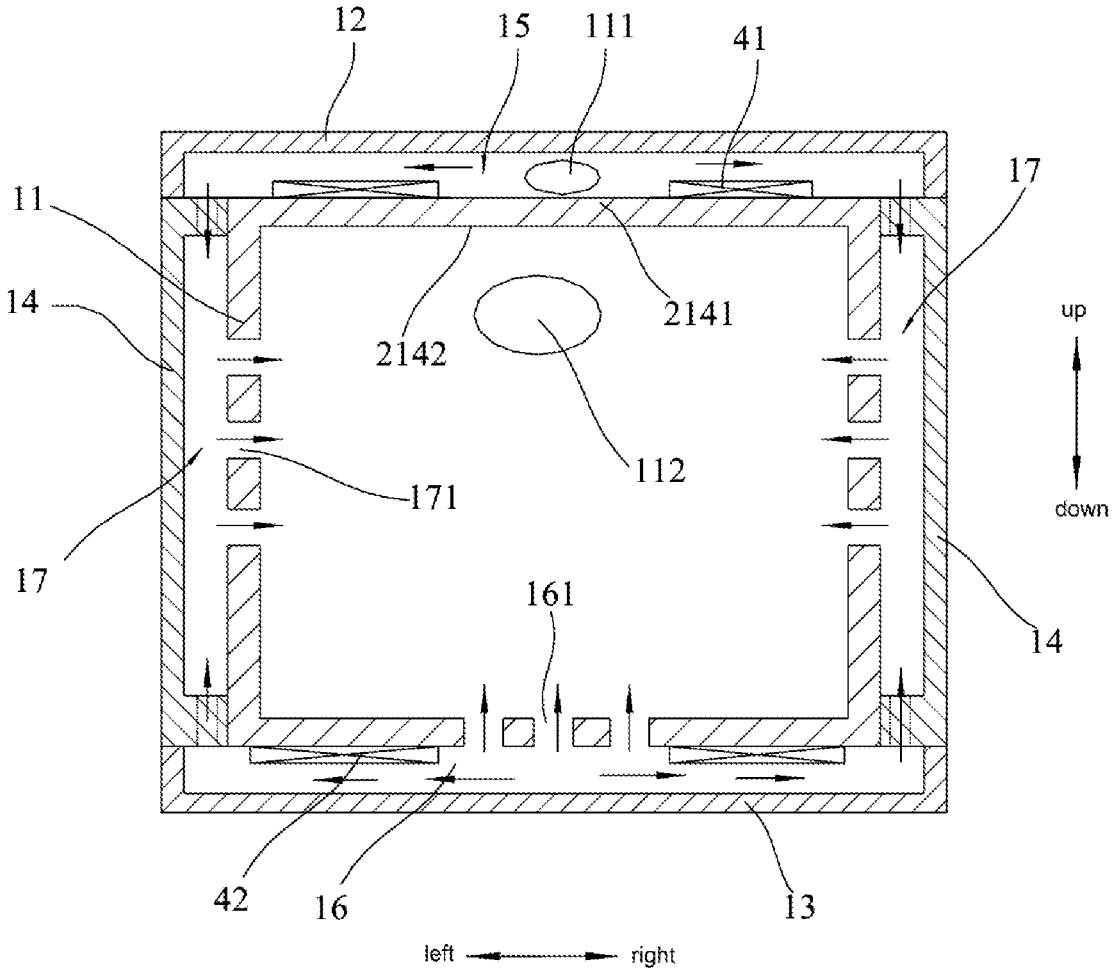
FIG. 9 is a schematic diagram of the principle of the air-cooled refrigeration equipment in some further embodiments of the present invention.

FIG. 9 is a schematic diagram of the principle of the air-cooled refrigeration equipment in some further embodiments of the present invention.

As shown in FIG. 9, in some other embodiments of the present invention, the device body 10 of the device further includes a top cover 12, a bottom cover 13, and side covers 14. The top cover 12 is positioned on a top side of the drawer container 11, and together with a top wall of the drawer container 11, defines a first accommodating cavity 15. The bottom cover 13 is positioned on a bottom side of the drawer container 11, and together with a bottom wall of the drawer container 11, defines a second accommodating cavity 16. The side cover 14 is positioned on the left and/or right side of the drawer container 11, and together with corresponding side wall of the drawer container 11, defines a communication channel 17. The first accommodating cavity 15 is used to place the first electromagnetic coil 41 and the first magnetic flux component 43. The second accommodating cavity 16 is used to place the second electromagnetic coil 42 and the second magnetic flux component 44. One end of the communication channel 17 is communicated with the first accommodating cavity 15, and the other end of the communication channel 17 is communicated with the second accommodating cavity 16.

Referring to FIG. 9, the cold air inlet 111 is formed on a side wall of the first accommodating cavity 15. At least one bottom through-hole 161 is provided on a top wall of the second accommodating cavity 16. One end of the bottom through-hole 161 is communicated with the second accommodating cavity 16, while the other end is communicated with the inner cavity of the drawer container 11. At least one side through-hole 171 is set on the side wall of the connected channel 17. One end of the side through-hole 171 is connected to the connected channel 17, while the other end is connected to the inner cavity of the drawer container 11.

Referring to FIG. 9, cold air from the cold air inlet 111 enters the first accommodating cavity 15 through the cold air inlet 111, cools the first electromagnetic coil 41 in the first accommodating cavity 15 and then enters the connected channel 17. A part of the cold air from the connected channel 17 enters the drawer container 11 through the side through-hole 171 and blows towards the side wall of the drawer 20. Another part of the cold air from the connected channel 17 enters the second accommodating cavity 16, and then enters the drawer container 11 through the bottom through-hole 161, blows towards the bottom wall of the drawer 20.

Alternatively, as needed, the side through-hole 171 can be omitted, and the cold air can enter the drawer container 11 through the bottom through-hole 161, and blow towards the bottom wall of the drawer 20.

The art of the invention will be appreciated by those skilled in the art. In some embodiments of the invention, by blowing the cold air towards the bottom wall and side wall of the drawer 20, the direct blowing of the stored objects in the drawer 20 is avoided, thereby preventing the loss of heat from the stored objects and preventing them from freezing.

The working principle of the air door 36 and the magnetic field generating apparatus 40 in the present invention will be elaborated upon with reference to FIG. 2.

In present invention, the magnetic field generating apparatus 40 and the detection apparatus 50 are configured as: when the detection apparatus 50 detects that the drawer 20 is pulled out, the magnetic field generating apparatus 40 is powered off to avoid wasting unnecessary work of the magnetic field generating apparatus 40 (i.e., the generated magnetic field will not affect the stored objects in the drawer 20), thereby improving the utilization rate of the magnetic field and reduces energy consumption.

Furthermore, when the magnetic field generating apparatus 40 is powered off, the air door 36 is closed, thereby preventing the air cooling system from providing cold air to the drawer 20. This prevents cold air from escaping from the open drawer 20, thereby reducing the cooling capacity of the air cooling refrigeration equipment and thus reducing the energy consumption of the air cooling refrigeration equipment. The air door 36 can then be opened when the magnetic field generating apparatus 40 is powered on, thereby allowing the air cooling system 30 to provide cold air to cool the stored objects in the drawer 20.

The air door 36 can be opened when the detection apparatus 50 detects that the drawer 20 has returned to its initial position (as shown in FIGS. 5 and 6, the position of the drawer 20 relative to the drawer container 11), and when the magnetic field generating apparatus 40 is powered on. This will allow the air cooling system 30 to provide cold air to the drawer 20. Specifically, when the user pulls the drawer 20 out of its pulled-out position and returns it to its position relative to the drawer container 11 in FIGS. 5 and 6, the magnetic field sensor 52 or micro switch 53 of the detection apparatus 50 is triggered, thereby causing the magnetic field generating apparatus 40 to be energized and start generating a magnetic field to preserve the objects stored in the drawer 20. When the air-cooled refrigeration equipment detects that the magnetic field generating apparatus 40 is energized, it opens the air door 36 to provide cold air from the air-cooling system 30 for the drawer 20.

In the event that the magnetic field generating apparatus 40 is energized, if the temperature sensor 60 detects that the temperature in the drawer 20 is in a preset high temperature range, the air door 36 is opened to provide cooling for the objects stored in the drawer 20. Conversely, if the temperature sensor 60 detects that the temperature within the drawer 20 is in a preset low temperature range, the air door 36 is closed to prevent the objects stored within the drawer 20 from freezing due to excessive cooling.

In this arrangement, the preset high temperature range refers to a temperature range with a temperature value is greater than or equal to the preset temperature value. The preset low temperature range refers to a temperature range with a temperature value is less than or equal to the preset temperature value. The preset temperature value is a temperature that can effectively preserve the stored objects, such as 0° C., −1° C., −2° C., −4° C., or any other feasible temperature value.

Furthermore, when the detection apparatus 50 detects that the drawer 20 has returned to its initial position, the magnetic field generating apparatus 40 is powered on only when the temperature inside the drawer 20 is lowered below the preset temperature. This ensures that the magnetic field generated by the magnetic field generating apparatus 40 only acts on the stored objects in the drawer 20 when the temperature is relatively low (especially near the freezing temperature), preventing the stored objects from freezing and reducing the energy consumption of the air-cooled refrigeration equipment.

Furthermore, to minimize the useless work of the magnetic field generating apparatus 40, the air cooling-type refrigeration device of the present invention further comprises a weighing sensor for weighing the drawer 20. Only when the weight detected by the weighing sensor exceeds the weight of the drawer 20 itself, the magnetic field generating apparatus 40 will be allowed to power on and the air door 36 will be allowed to open, thereby avoiding wasteful electrical energy and cooling capacity.

Alternatively, the weighing sensor can be replaced with an image recognition unit to judge whether there are objects stored in the drawer 20. If the image recognition unit identifies that there are objects stored in the drawer 20, the magnetic field generating apparatus 40 is allowed to be powered on and the air door 36 is allowed to be opened, thereby avoiding the waste of electrical energy and cooling capacity.

So far, it should be appreciated by those skilled in the art that while various exemplary embodiments of the invention have been shown and described in detail herein, many other variations or modifications which are consistent with the principles of this invention may be determined or derived directly from the disclosure of the present invention without departing from the spirit and scope of the invention. Accordingly, the scope of the invention should be understood and interpreted to cover all such other variations or modifications.

What is claimed is:

1. An air cooling-type refrigeration device, comprising:

a device body, an air-cooling system attached to the device body, and a drawer that can be pulled out relative to the device body, the drawer being capable of receiving cold air provided by the air-cooling system to cool objects stored in it;

wherein the air cooling-type refrigeration device comprises a magnetic field generating apparatus and a detection apparatus, when powered on, the magnetic field generating apparatus generates a magnetic field that acts on the objects stored in the drawer, the detection apparatus is used to detect whether the drawer is pulled out;

the magnetic field generating apparatus and the detection apparatus are configured such that the magnetic field generating apparatus is powered off when the detection apparatus detects that the drawer is pulled out.

2. The air cooling-type refrigeration device according to claim 1, wherein the air cooling system comprises an air door, the air door is configured to close when the magnetic field generating apparatus is in a power-off state, for preventing the air cooling system from providing cold air to the drawer, the air door is opened when the magnetic field generating apparatus is in a power-on state, for allowing the air cooling system to provide cold air to the drawer.

3. The air cooling-type refrigeration device of claim 2, wherein the air door is configured to open when the detection apparatus detects that the drawer has returned to the initial position, and the magnetic field generating apparatus is powered on, for allowing the air cooling system to provide cold air to the drawer.

4. The air cooling-type refrigeration device according to claim 2, wherein the air-cooled refrigeration equipment further comprises a temperature sensor for detecting the temperature in the drawer, the air door is further configured to open if the temperature sensor detects that the temperature inside the drawer is within a preset high temperature range while the magnetic field generating apparatus is energized, and the air door is configured to close if the temperature sensor detects that the temperature inside the drawer is within a preset low temperature range.

5. The air cooling-type refrigeration device according to claim 1, wherein the detection apparatus comprises a magnet and a magnetic field sensor, one of the magnet and the magnetic field sensor is arranged on the drawer, and the other is arranged on the device body.

6. The air cooling-type refrigeration device according to claim 5, wherein the magnetic field sensor is a Hall switch or a reed switch.

7. The air cooling-type refrigeration device according to claim 1, wherein the detection apparatus comprises a micro switch, and the micro switch is installed on the device body or the drawer.

8. The air cooling-type refrigeration device according to claim 1, wherein the magnetic field generation device comprises a first electromagnetic coil and a second electromagnetic coil disposed on opposite sides of the drawer.

9. The air cooling-type refrigeration device according to claim 8, wherein the magnetic field generation device additionally comprises a first magnetic guiding component corresponding to the first electromagnetic coil and a second magnetic guiding component corresponding to the second electromagnetic coil; and/or the air cooling-type refrigeration device further comprises a first accommodating cavity for receiving the first electromagnetic coil and a second accommodating cavity for receiving the second electromagnetic coil, the first accommodating cavity and the second accommodating cavity are communicated with the drawer, thereby allowing the cold air provided by the air cooling system to enter the drawer through the first accommodating cavity and the second accommodating cavity.

10. The air cooling-type refrigeration device according to claim 1, wherein the magnetic field generating apparatus is further configured to energize when the temperature inside the drawer drops below a predetermined temperature.

* * * * *